US007523557B2

(12) United States Patent
Smith et al.

(10) Patent No.: US 7,523,557 B2
(45) Date of Patent: Apr. 28, 2009

(54) CARPENTER'S PENCIL SHARPENER

(75) Inventors: Craig W. Smith, Batavia, IL (US); Joseph Donaldson, Wheaton, IL (US)

(73) Assignee: Flade LLC, Villa Park, IL (US)

( * ) Notice: Subject to any disclaimer, the term of this patent is extended or adjusted under 35 U.S.C. 154(b) by 0 days.

(21) Appl. No.: 11/305,949

(22) Filed: Dec. 19, 2005

(65) Prior Publication Data

US 2006/0185178 A1 Aug. 24, 2006

Related U.S. Application Data

(63) Continuation of application No. 10/701,810, filed on Nov. 5, 2003, now abandoned.

(51) Int. Cl.
*B43L 23/08* (2006.01)

(52) U.S. Cl. ..... 30/457; 30/451

(58) Field of Classification Search ..... 30/451, 30/452, 454, 456, 457, 458, 459, 461; 144/28.1, 144/28.11; D19/73
See application file for complete search history.

(56) References Cited

U.S. PATENT DOCUMENTS

| | | | | | |
|---|---|---|---|---|---|
| 1,204,959 | A * | 11/1916 | Duncan | 15/105.53 |
| 1,596,698 | A * | 8/1926 | Von Sandt | 30/458 |
| 1,744,812 | A * | 1/1930 | Siptrott | 30/460 |
| 2,366,928 | A * | 1/1945 | Paschell | 30/457 |
| 2,470,387 | A * | 5/1949 | Baggett | 144/28.11 |
| 2,982,253 | A * | 5/1961 | Herbold | 30/461 |
| 4,081,010 | A * | 3/1978 | Galli | 30/451 |
| 4,281,698 | A * | 8/1981 | Mobius | 30/454 |
| 6,092,293 | A * | 7/2000 | Donaldson | 30/457 |
| 6,286,218 | B1 * | 9/2001 | Luttgens | 30/454 |
| 6,571,480 | B1 * | 6/2003 | Qiu | 30/457 |
| 6,725,549 | B2 * | 4/2004 | Jebe et al. | 30/452 |
| 6,732,437 | B2 * | 5/2004 | Eisen et al. | 30/461 |
| 6,948,251 | B2 * | 9/2005 | Jebe et al. | 30/452 |
| 6,966,117 | B1 * | 11/2005 | Cannon | 30/451 |
| 2005/0005459 | A1 * | 1/2005 | Donaldson | 30/457 |

* cited by examiner

*Primary Examiner*—Hwei-Siu C Payer
(74) *Attorney, Agent, or Firm*—Patzik, Frank & Sanotny Ltd.

(57) ABSTRACT

A carpenter's pencil sharpener is designed for cutting a point on a carpenter's pencil that defines a longitudinal axis and has a maximum width or dimension (MD) perpendicular to the longitudinal axis. The sharpener has a contouring portion defining a rotational axis, a pencil point contour surface and a blade. The sharpener also has a centering portion at least rotationally fixed to the contouring portion. The centering portion has a non-rotating, cylindrical, inner surface and an outer end defining an aperture for receiving the carpenter's pencil. The cylindrical surface has an inner diameter (ID) dimensioned to fit the maximum dimension (MD) of the carpenter's pencil, and is large enough to permit rotation of the carpenter's pencil within the cylindrical surface. The centering portion also has a length (L) generally parallel to the rotational axis and measured from the contouring portion to the outer end for maintaining the carpenter's pencil parallel to the axis. With this configuration, radial motion of the carpenter's pencil relative to the rotational axis is limited when the carpenter's pencil is rotated within the inner surface.

21 Claims, 6 Drawing Sheets

CARPENTER'S PENCIL SHARPENER

CROSS-REFERENCE TO RELATED APPLICATION

This application is a continuation of prior Application No. 10/701,810, filed Nov. 5, 2003, now abandoned.

TECHNICAL FIELD OF THE INVENTION

The present invention relates generally to devices for sharpening pencils, and more particularly to pencil sharpeners designed for non-circular (e.g. flattened or oval) style of carpenter's pencils.

BACKGROUND OF THE INVENTION

The need for a sharpening device designed for the sharpening of a carpenter's pencil has long been well known, as sharpening has generally required the use of a knife to accommodate the odd shape of the pencil. The difficulty of sharpening this style of pencil with such a sharpening device without leaving wood on the broad sides of the rectangular pencil lead has long presented a major obstacle. For example, in U.S. Pat. No. 5,077,903 a sharpener is presented with dual rotary cutter assemblies arranged to cut two curves in the point. In U.S. Pat. Nos. 4,759,129 and 4,918,816 four cutters and associated gearing are similarly used to achieve the desired sharpening effect on a carpenter's pencil. In U.S. Pat. No. 4,081,010 a cutting blade is driven around the pencil in a complicated "eccentric" motion by means of cams to achieve the required pencil point shaping. All of these references, however, require complex configurations with many parts such as blades, gears and motors.

One solution is presented by U.S. Pat. No. 6,092,293 issued to Donaldson. Donaldson discloses the use of a curved or bent blade which enables the blade to more closely form an ideal contour of the carpenter's pencil as it is rotated. The curved or bent blade removes enough wood to expose a good writing pencil tip but not too much wood resulting in a weak tip that could break with little pressure.

The sharpener from the '293 patent uses a snap-fit, rotatable centering collar that is attached to a housing that also has a concave-cone surface that holds the blade. The centering collar has a hole that is sized to match octagonal edges of the non-circular pencil, completely fixing the pencil within the centering collar so that the centering collar rotates with the pencil. The centering collar maintains the pencil at a centered position for sharpening. Otherwise a misalignment of pencil to blade and cone surface can cause lead breaks and jamming.

Another similar solution that copies the '293 design is presented by U.S. Pat. No. 6,571,480 issued to Qui that presents a more complicated, rotatable centering collar that is also rotatably attached to a blade housing. The collar is locked in a chamber of the sharpener by a separate removable plastic clip that is prone to breaking when removing the clip to clean the sharpener.

However, because a moving part, the rotatable centering collar, is required, the sharpener will not work if something (e.g. dust or debris) jams the collar so that it cannot rotate. In addition, because the centering collar is a separate part that requires it own molding/manufacturing process and then an assembly process for attachment to the main housing, it adds relatively significant production cost. Thus, another more economical alternative solution may be desired.

Another problem with carpenter's pencil sharpeners is that while the sharpener cuts well when the grain of the wood on the pencil is parallel to the blade, when the blade is cutting the pencil crossgrain, it takes more force to rotate the pencil on the blade, and the straight edge of the blade often binds, causing choppiness (jumping of the pencil on the blade) leading to frequent breaks and jams. Thus, a carpenter's pencil sharpener that cuts well, no matter the direction of the wood grain on the carpenter's pencil, is desired.

SUMMARY OF THE INVENTION

The present invention discloses a simplified and economical solution for a device which will sharpen a carpenter's pencil without the need of providing a separate rotating centering collar. Particularly, a carpenter's pencil sharpener is designed for cutting a point on a carpenter's pencil that defines a longitudinal axis and has a maximum width or dimension (MD) perpendicular to the longitudinal axis. The sharpener has a contouring portion defining a rotational axis and a pencil point contour surface defined therein about the rotational axis. A blade is mounted within the contouring portion and has a cutting edge positioned along the contour surface for cutting against the carpenter's pencil when the carpenter's pencil is rotated about the rotational axis. The sharpener also has a centering portion at least rotationally fixed to the contouring portion (i.e., the centering portion does not rotate about the rotational axis and relative to the contouring portion during sharpening). The centering portion has a non-rotating, cylindrical inner surface With an outer end defining an aperture for receiving the carpenter's pencil. The cylindrical surface has an inner diameter (ID) dimensioned to fit the maximum dimension (MD) of the carpenter's pencil. The inner diameter (ID) is large enough to permit rotation of the carpenter's pencil within the cylindrical surface. The centering portion also has a length (L) generally parallel to the rotational axis and measured from the contouring portion to the outer end for maintaining the carpenter's pencil parallel to the axis. With this configuration, radial motion of the carpenter's pencil relative to the rotational axis is limited when the carpenter's pencil is rotated within said inner surface.

In another aspect of the invention, the carpenter's pencils have a varying maximum dimension from pencil to pencil due to production tolerances. The tolerances define a range of possible unsharpened widths for the pencils from a maximum MD to a minimum MD. The length (L) of the centering portion is selected for maintaining a pencil with the minimum MD parallel to the axis. The inner diameter (ID) of the cylindrical surface is selected to be larger than the maximum MD, which permits a pencil with the maximum MD to rotate within the cylindrical surface.

In one preferred embodiment, the centering portion has a collar with a length (L) of approximately at least 1.25 inches and an inner diameter (ID) of one selected from the group consisting of approximately 0.605 inches, 0.545 inches, 0.515 inches and 0.495 inches to correspond to the widths or maximum dimensions (MD) of four known carpenter's pencil sizes.

In yet another aspect of the invention, it has been found that the advantage of the length of the centering portion can be represented by its percentage of the length of the contouring portion. Thus, the centering portion has a length (L) at least 60% the length of the contouring portion, and alternatively any one of at least 70%, 77%, 80% and 83% of the contouring portion.

Finally, in yet a further aspect of the invention, a carpenter's pencil sharpener has a body with a contouring surface for guiding a carpenter's pencil and a serrated blade disposed on the contouring surface. This provides good carpenter's pencil tips no matter the direction of the wood grain on the carpenter's pencil.

BRIEF DESCRIPTION OF THE DRAWINGS

Further aspects of the invention will be discerned with reference to the following detailed description when taken in conjunction with the drawings, in which.

DETAILED DESCRIPTION OF ILLUSTRATED EMBODIMENT

Figure 1:
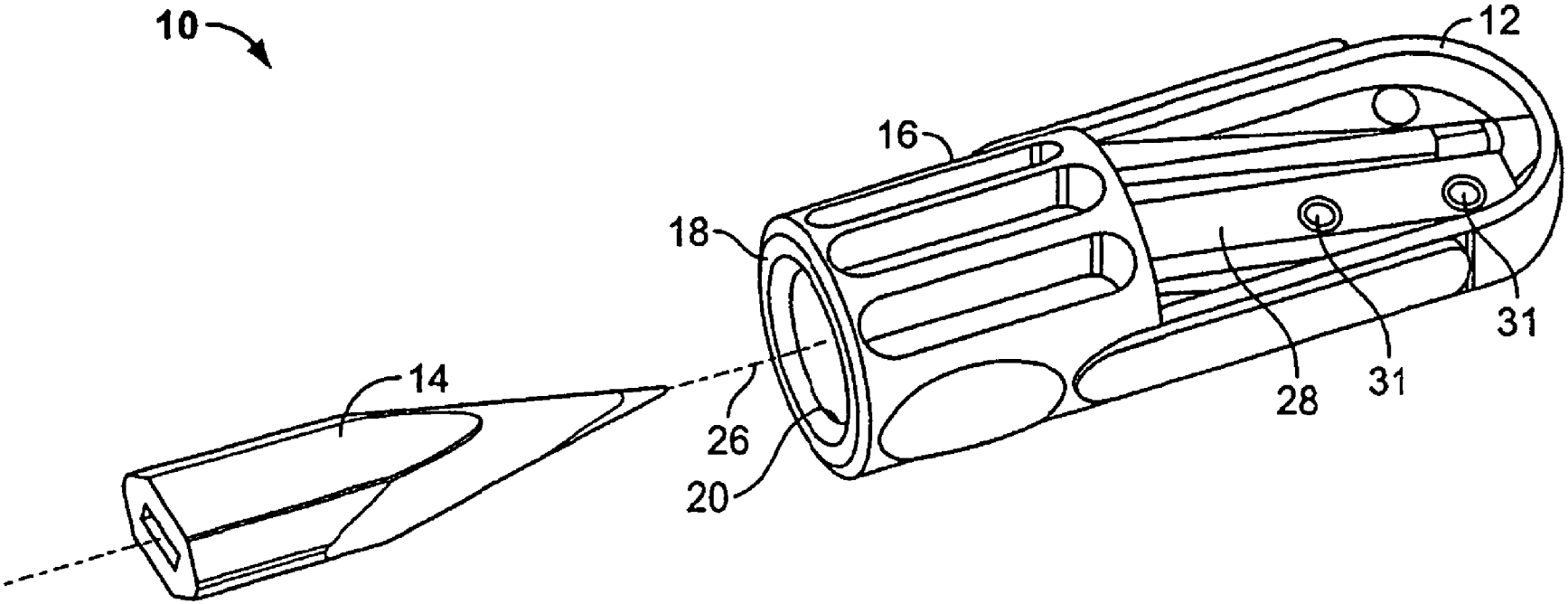
FIG. 1 is a perspective view of a sharpener and a carpenter's pencil according to the present invention.
Figure 2:
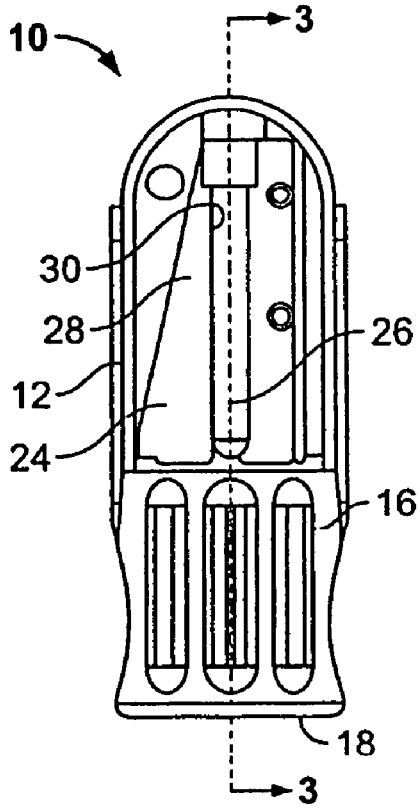
FIG. 2 is a top view of the sharpening device of FIG. 1.

Referring to FIGS. 1-5, a pencil sharpening device, or simply sharpener, in accordance with the present invention is generally indicated at 10 and has a contouring portion 12 (also called a base or base enclosure) for cutting or shaping a carpenter's pencil 14, and a pencil centering portion 16 fixed to the contouring portion such that the centering portion 16 does not rotate relative to the contouring portion 12. The contouring portion and centering portion preferably cooperatively define a rotational or longitudinal axis 26.

The centering portion 16 is preferably in the shape of tubular or cylindrical collar (thus, the centering portion is also referred to herein as the centering collar or just collar 16) although other shapes for the centering portion are contemplated. The centering collar 16 has an outer end 18 defining an aperture or opening 20 for insertion of the carpenter's pencil 14 to be sharpened. The collar 16 also has an inner cylindrical surface 22 (FIGS. 3-4) communicating with the opening 20. The opening 20 and inner cylindrical surface 22 allow rotation of the carpenter's pencil 14 within the collar 16 preferably about rotational axis 26.

Within the contouring portion 12, a pencil point contour surface 24 is defined about rotational axis 26. As shown most clearly in FIGS. 2 and 3, in this embodiment, contour surface 24 is of the general shape of a right circular cone oriented to present its narrow portion at the far end of the sharpener where a point extremity of pencil 14 placed within the sharpener would be located. The contour surface 24 widens along its length toward the collar 16 for accommodating a pencil shaft away from the point extremity.

A flat, serrated blade 28 is generally aligned with an edge 30 (FIG. 2) of the contour surface 24. The blade 28 is preferably serrated to provide a good quality cut without binding (or jams), choppiness and lead breaks, no matter if the blade is cutting cross-grain or parallel with the grain on the pencil 14. Of course, a straight blade could be used on the present sharpener with collar 16 instead.

Figure 3:
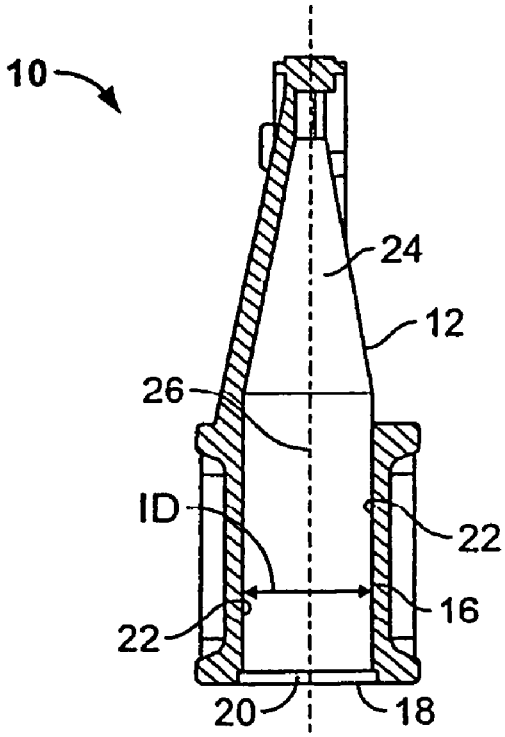
FIG. 3 is a cross section of the sharpening device of FIG. 2 along line 3-3.
Figure 4:
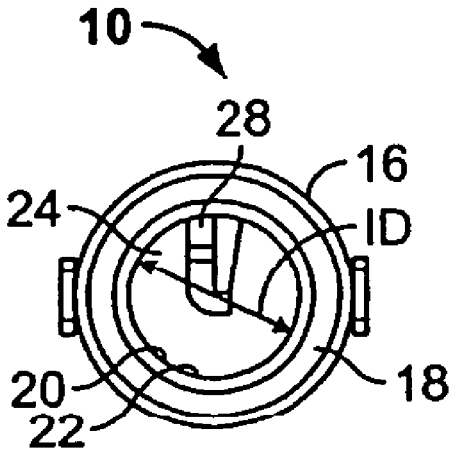
FIG. 4 is a collar end view of the sharpening device of FIG. 1.
Figure 5:
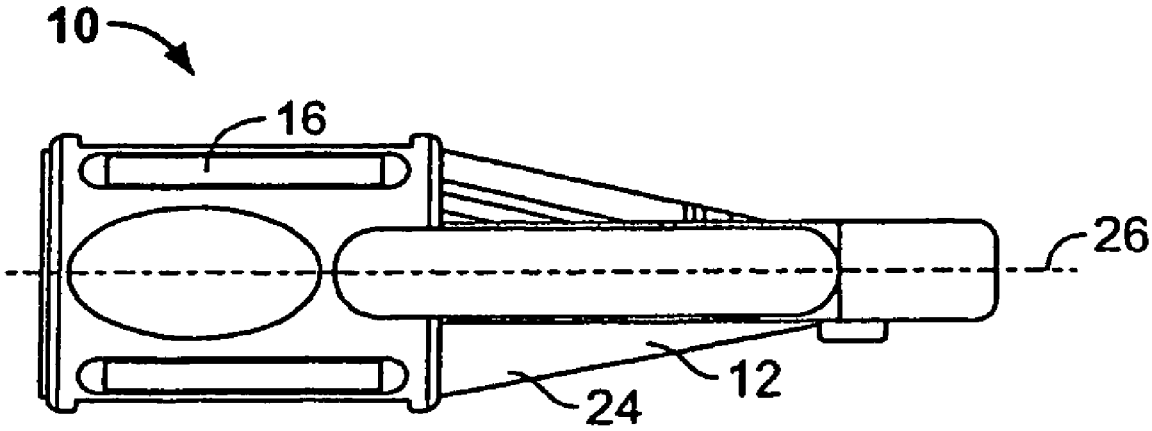
FIG. 5 is a side view of the sharpener of FIG. 1.

As best shown in FIG. 3, in one embodiment, the centering collar or portion 16 is integrally formed with the contouring portion 12 and contour surface 24 so that the sharpener 10 is manufactured as a single piece (except for the blade 28 and optionally screws or studs 31 that holds the blade to the contouring portion 12) eliminating all moving parts and reducing the total number of parts needed to manufacture and assemble the sharpener. Thus, the centering portion 12 is completely fixed to the contouring portion (rotationally, laterally, and longitudinally relative to rotational axis 26).

Figure 9:
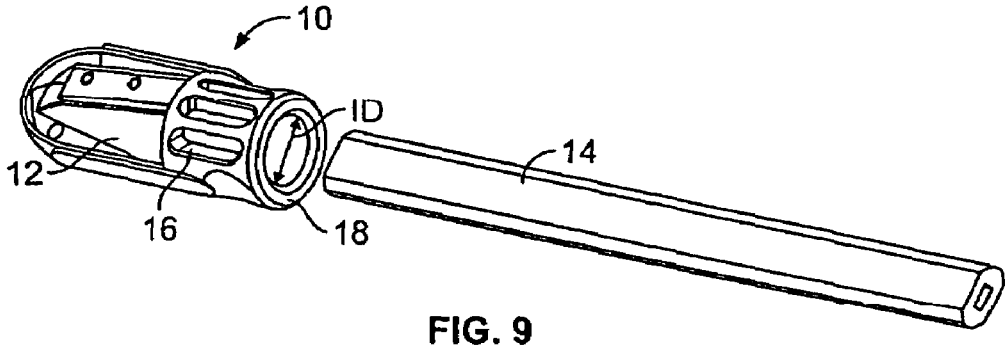
FIG. 9 is another perspective view of the sharper of the present invention shown with a carpenter's pencil.
Figure 10:
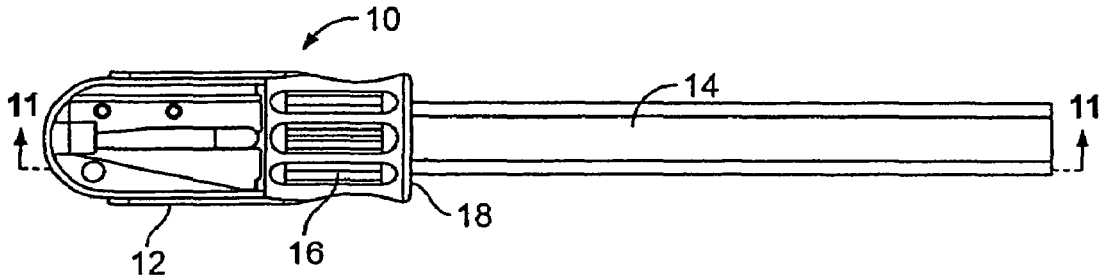
FIG. 10 is a top view of the sharpener and carpenter's pencil according to the present invention.

The inner cylindrical surface 22 has an inner diameter ID shown on FIG. 3 and FIG. 9 that is large enough to allow the carpenter's pencil to rotate within it, yet small enough to maintain contact with the carpenter's pencil to keep the pencil straight or centered on rotational axis 26. If the diameter ID is too large, the carpenter's pencil 14 will move radially relative to rotational axis 26 as shown by dimension "m" on FIG. 11 causing pencil jams and/or lead breaks within the contour surface 24. Thus, ID must be larger, but not too much larger, than the width of the carpenter's pencil.

Figure 6:
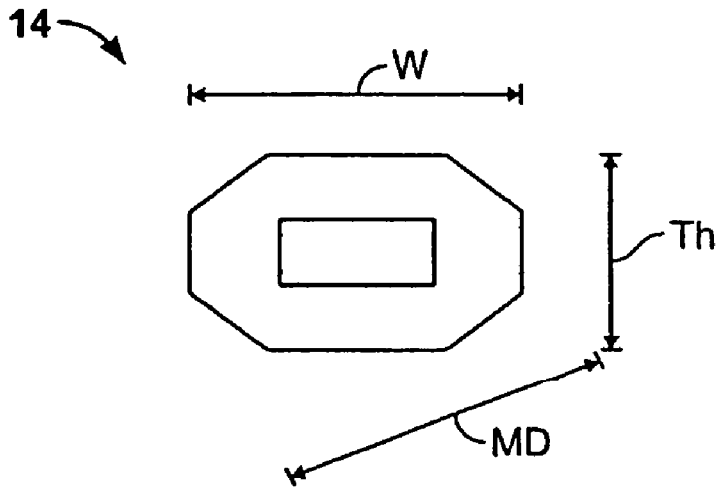
FIG. 6 is a cross-section of a first type of carpenter's pencil for use with the sharpener of the present invention.
Figure 7:
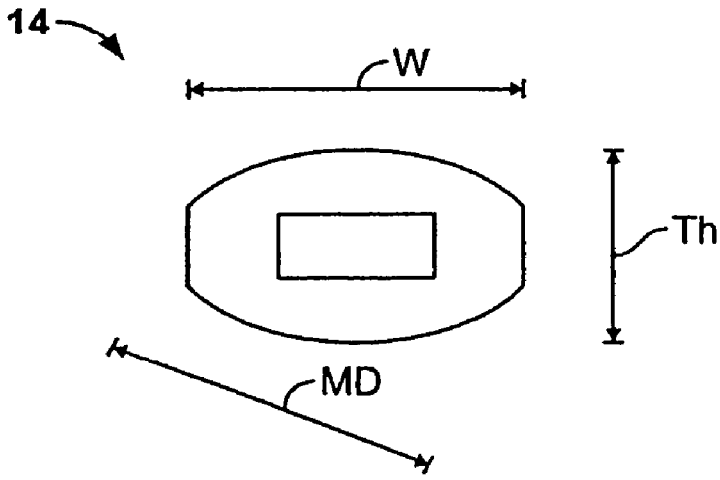
FIG. 7 is a cross-section of a second type of carpenter's pencil for use with the sharpener of the present invention.
Figure 8:
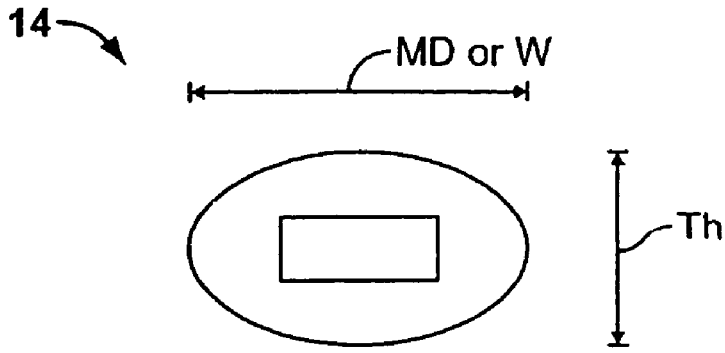
FIG. 8 is a cross-section of a third type of carpenter's pencil for use with the sharpener of the present invention.

Referring to FIGS. 6-8, the non-circular carpenter's pencils have cross-sections orthogonal to the carpenter's pencil's longitudinal axis. The cross-sections have a horizontal width (w), a vertical thickness (th) and a maximum dimension (MD) which is the diameter or width in cross section of the pencil and perpendicular or radial relative to rotational axis 26 that must be cleared for the pencil to rotate. In other words, ID must belarger than MD. A problem arises, however, because a manufacturing or production tolerance results in a range of MDs for each style or size of pencil from a "max. MD" to a"min. MD."

Currently, three styles of carpenter's pencils are available providing four sizes (the oval pencil of FIG. 8 comes in two sizes) as specified in Table 1 below. The Standard North American Carpenter's Pencil (SNACP) has an octagon shape with a max. MD of 0.600 inches that varies 0.04 inches during manufacture down to a min. MD of 0.560 inches. The ID of the inner surface 22 of the collar 16 must be larger than the max. MD taking the manufacturing or production tolerances or variations into account. It has been found that 0.005 inches larger is adequate to permit rotation of the largest size pencil. Thus, for the SNACP, ID of the collar 16 is set at 0.605 inches as shown on Table 1. This limits the space for lateral motion of the smallest pencil to 0.045 inches (ΔMD+0.005).

TABLE 1

(all values in inches)

| | SHAPE | Max. MD | PROD. VAR. (ΔMD) | Min. MD | COLLAR ID |
|---|---|---|---|---|---|
| SNACP | OCT. | 0.600 | 0.04 | 0.560 | 0.605 |
| SECP | OVAL | 0.540 | 0.03 | 0.510 | 0.545 |
| | SEMI-OVAL | 0.510 | 0.06 | 0.450 | 0.515 |
| | OVAL | 0.490 | 0.03 | 0.460 | 0.495 |

The other three sizes are Standard European Carpenter's Pencils (SECP) and have a MD as shown on Table 1. The semi-oval style (FIG. 7) has the largest variation of MD which is 0.06 inches. For each of these pencils, the ID is also set in Table 1 at 0.005 inches larger than the max. MD of each pencil. For the two oval styles (FIG. 8), the MD is the same as the horizontal width w of the pencils and the production variance of MD is 0.03 inches It is preferred that each pencil style/size shown on Table 1 is provided with its own sharpener. Thus, for example, the single SNACP sharpener is specifically designed for a pencil MD of 0.60 to 0.56 inches, and similarly each of these SECP pencils has its own sharpener for the corresponding MD range.

In the alternative, however, it will be appreciated that a single pencil sharpener could be designed to sharpen a number of the different sizes shown or other future designs. Thus, although not preferred, it is contemplated that a sharpener could be designed for a max. MD of 0.600 inches on SNACP yet also able to sharpen the smallest semi-oval carpenter's pencil with a minimum MD of 0.45 inches. This design of course would not necessarily work as well as the sharpeners with more limited lateral space in the centering collar 16 and may require a length L (explained below) that is too long to be cost effective.

Figure 11:
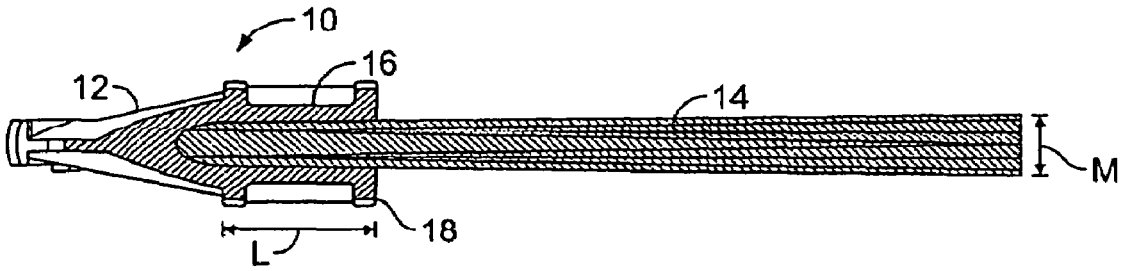
FIG. 11 is a cross-sectional side view taken along line 11-11 on FIG. 10 of the sharpener according to the present invention and revealing the position of the carpenter's pencil.

Providing the inner surface 22 with a certain inner diameter ID alone will not maintain the carpenter's pencil centered or parallel to the rotational axis 26. If the centering collar 16 and inner surface 22 has a longitudinal length L (the distance from the contouring portion 12 to the outer end 18 as shown in FIG. 11) parallel to rotational axis 26 that is too short, the pencil will move laterally or radially from rotational axis 26 and misalign (as shown by lateral misalignment dimension m on FIG. 11) causing jams and lead breaks at the blade.

In order to avoid lateral or radial misalignment off of (or non-parallel to) axis 26, the collar 16 must be lengthened until it adequately maintains the carpenter's pencil parallel to the axis. The longer the collar 16 is, the farther the collar outer end 18 is disposed from the contour surface 24, which are the two distal (or farthest apart) contact areas the carpenter's pencil will touch as it is rotated for sharpening within the sharpener 10. The farther apart these two contact points are along the length of the carpenter's pencil 14, the less the lateral or radial motion of the carpenter's pencil away from the rotational axis 26. For this purpose, the collar 16 should have a length L as long as possible.

However, too much lengthening of the collar 16 wastes a certain length of the carpenter's pencil since the carpenter's pencil will be too short to sharpen once the unsharpened shaft of the carpenter's pencil is shorter than the collar 16 (and is therefore too short to hold on to and turn). In addition, there is the additional cost associated with a longer collar 16. Thus, for this purpose, the collar 16 length L should be as short as possible.

The compromise between these two conflicting requirements is to provide a collar 16 as short as possible where the length sufficiently maintains the carpenter's pencil parallel to the axis 22 to provide an adequate sharpened point (i.e. where the pencil will not jam and break). This has been found where the lateral or radial misalignment "m" (FIG. 11) at the distal end of an unsharpened, standard 7 inch carpenter's pencil positioned in the sharpener for sharpening is less than approximately 1.5" total or 0.75 inches to one side of axis 26 for the smallest size pencil (i.e. for min. MD).

To determine the length L, different lengths of collars were tested for the SNACP pencil until an adequate point could be consistently achieved. Example results for the SNACP is shown on Table 2. Here, a sharpener ID for an SNACP pencil should have a collar with L=1.25" and an ID=0.605".

TABLE 2

| | Misalignment m (in.) for SNACP | |
|---|---|---|
| L | For 0.60" max. MD | For 0.56" C.P. for SNACP |
| 0.5" | 1.056 | 4.246 |
| 1.0" | 0.681 | 2.247 |
| 1.25" | 0.528 | 1.427 |
| 2.0" | 0.483 | 1.183 |
| 3.0" | 0.415 | 0.831 |

The remaining European pencils can be tested similarly. It is believed, however, that the SECP pencils will indicate the same general length as the SNACP pencils.

It has also been found that the improvement of the present invention can be represented by the length of the collar 16 relative to the length of the contouring portion 12. Thus, in the present case with a collar having L=1.25 inches long and a contouring portion 1.5 inches long (for a total preferred length of the sharpener of the present invention of 2.75 inches) the collar is 83% of the length of the contouring portion. Providing a 1.25 inch collar on other known contouring portions reveals length percentages of 77%, 95% and 100%. Generally, the elongated collar 16 is represented by the range of at least 60% to 70% or higher.

Figure 12:
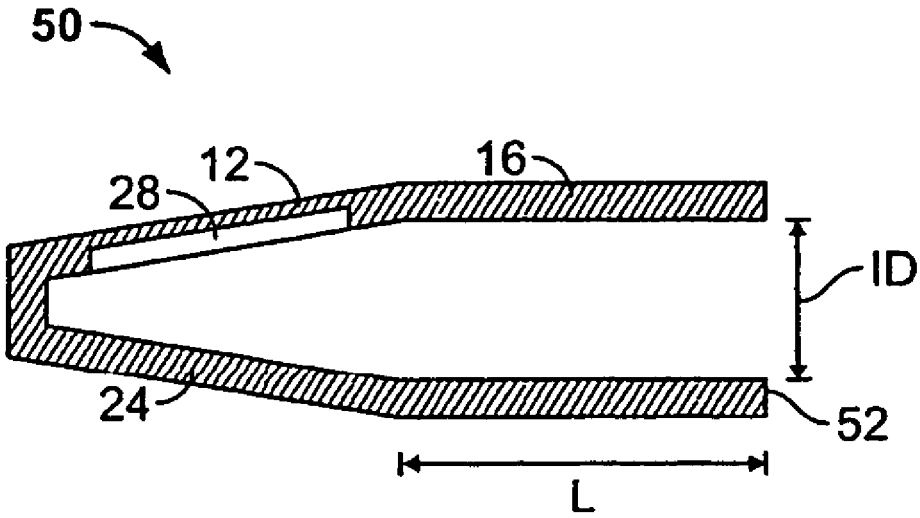
FIG. 12 is a simplified cross-sectional side view of an alternative sharpener according to the present invention.

Referring to FIG. 12, a sharpener 50 is show. The sharpener 50 is show to be a one-piece molded unit having a blade 28 and an outer end 52.

Figure 13:
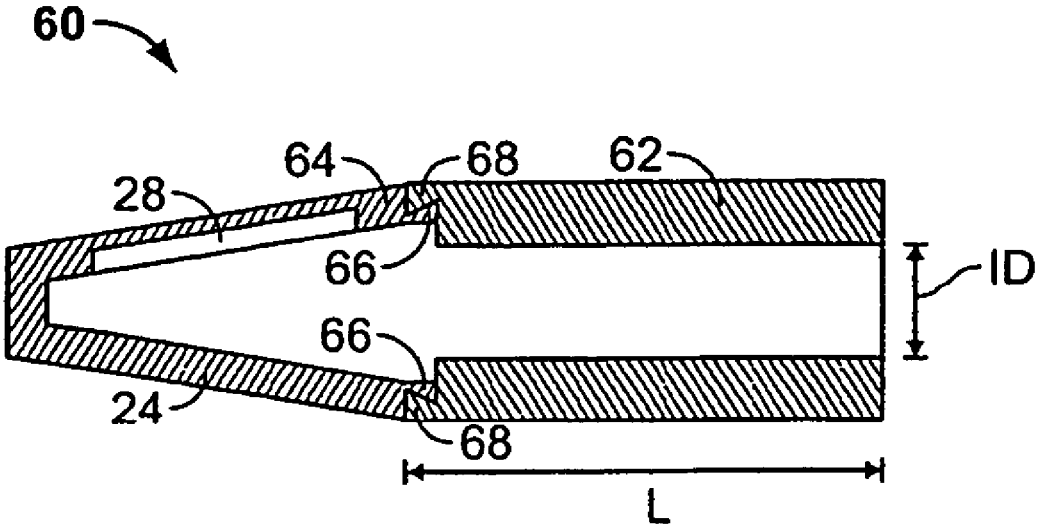
FIG. 13 is a simplified cross-sectional side view of another alternative sharpener according to the present invention.

Referring to FIG. 13, in yet another alternative aspect of the invention, a sharpener 60 has a centering portion 62 that is laterally/radially fixed to contouring portion 64 but is longitudinally detachable or removable relative to axis 26 so that the collar can be changed for cleaning or to accommodate different sizes of carpenter's pencils. This can be accomplished by, for example, two or more opposing, locking clips 66, 68 on small areas of the circumference of the collar 62 (i.e. not all the way around) that fix the collar 62 to the contouring portion 64 laterally/radially yet allow the collar 62 to be detached longitudinally.

The problems solved by the present carpenter's pencil sharpener are now apparent. The sharpener 10 has a contouring portion 12 fixed to a centering portion 16. The centering portion 16 has an inner cylindrical surface 22 with an inner diameter ID selected to accommodate the maximum dimension MD of a carpenter's pencil so that the pencil can rotate within the centering portion 16 with manufacturing tolerances considered. The length L of the centering portion 16 is set to adequately maintain the pencil substantially parallel to a rotational axis 26 of the sharpener 10 by further restricting lateral or radial motion of the carpenter's pencil.

From the foregoing description, it will be apparent that modifications can be made to the apparatus without departing from the teachings of the present invention. Accordingly, the scope of the invention is only to be limited as necessitated by the accompanying claims.

While preferred embodiments of the present invention have been illustrated in the appended drawing and described in the detailed description above, the present invention is not limited thereto but only by the scope and spirit of the appended claims.

We claim:

1. A combination carpenter's pencil and carpenter's pencil sharpener for cutting a point on a carpenter's pencil, comprising:

a carpenter's pencil having a longitudinal axis, a non-circular cross section orthogonal to the longitudinal axis, and a maximum dimension (MD) of the non-circular cross section of at least 0.450 inches;

a carpenter's pencil contouring portion defining a rotational axis and having a carpenter's pencil point contour surface defined therein about said rotational axis;

a blade mounted on said carpenter's pencil contouring portion and having a cutting edge positioned along said carpenter's pencil point contour surface for cutting against the carpenter's pencil when the carpenter's pencil is rotated about said rotational axis; and a carpenter's pencil centering portion extending from said carpenter's pencil contouring portion and having a cylindrical inner surface and an outer end defining an aperture for receiving the carpenter's pencil and providing access to said cylindrical inner surface, said cylindrical inner surface having an inner diameter (ID) dimensioned to fit said maximum dimension (MD) of said carpenter's pencil and large enough to permit rotation of the carpenter's pencil within said cylindrical inner surface, and said carpenter's pencil centering portion having a length (L) parallel to said rotational axis and measured from said contouring portion to said outer end for maintaining, in combination with the inner diameter (ID), the carpenter's pencil sufficiently parallel to said rotational axis to avoid jams and lead breaks at said blade, wherein radial motion of the carpenter's pencil relative to said rotational axis is limited while the carpenter's pencil is rotated within said cylindrical inner surface.

2. The combination carpenter's pencil and carpenter's pencil sharpener of claim 1, wherein said maximum dimension (MD) of the carpenter's pencil varies from pencil to pencil due to manufacturing tolerances forming a range of said maximum dimensions (MD) from a max. MD to a min. MD, wherein said inner diameter is sized to accept said carpenter's pencil with said max. MD.

3. The combination carpenter's pencil and carpenter's pencil sharpener of claim 1, wherein the sharpener is for sharpening a seven inch carpenter's pencil positioned in the sharpener for sharpening, the sharpener further comprising said length (L) of said centering portion having a length sufficient to maintain the carpenter's pencil sufficiently parallel to the rotational axis so as to limit radial motion of a distal end of the seven inch carpenter's pencil relative to said rotational axis, said motion being limited to at most about 0.75 inches from said rotational axis.

4. The combination carpenter's pencil and carpenter's pencil sharpener of claim 1, wherein said length (L) of said centering portion is approximately 1.25 inches long.

5. The combination carpenter's pencil and carpenter'pencil sharpener of claim 1, wherein said inner diameter of said cylindrical surface is one selected from the group consisting of approximately 0.605 inches, 0.545 inches, 0.515 inches and 0.495 inches.

6. The combination carpenter's sharpener of claim 1, wherein said centering portion is a tubular collar, and wherein said inner cylindrical surface is an inner surface of said collar.

7. The combination carpenter's pencil and carpenter's pencil sharpener of claim 1, wherein said centering portion is longitudinally detachable from said contouring portion.

8. The combination carpenter's pencil and carpenter's pencil sharpener of claim 1. wherein said centering portion is secured to said contouring portion so that it cannot rotate, move laterally and move longitudinally relative to said contouring portion.

9. The combination carpenter's pencil and carpenter's pencil sharpener of claim 1, wherein said centering portion is integrally formed with said contouring portion cooperatively forming a single piece.

10. The combination carpenter's pencil and carpenter's pencil sharpener of claim 1, wherein said blade has a serrated cutting edge.

11. The combination carpenter's pencil bind carpenter's pencil sharpener of claim 1, wherein said centering portion is at least 60% as long as said contouring portion.

12. The combination carpenter's pencil and carpenter's pencil sharpener of claim 1, wherein said centering portion is at least 70% as long as said contouring portion.

13. The combination carpenter's pencil and carpenter's pencil sharpener of claim 1, wherein said centering portion is at least 77% as long as said contouring portion.

14. The combination carpenter's pencil and carpenter's pencil sharpener of claim 1, wherein said centering portion is at least 80% as long as said contouring portion.

15. The combination carpenter's pencil and carpenter's pencil sharpener of claim 1, wherein said centering portion is at least 83% as long as said contouring portion.

16. A combination carpenter's pencil and carpenter's pencil sharpener for cutting a point on a carpenter's pencil, comprising:

a carpenter's pencil having a longitudinal axis, a non-circular cross section orthogonal to the longitudinal axis, and a maximum dimension (MD) of the non-circular cross section of at least 0.450 inches;

a carpenter's pencil contouring portion defining a rotational axis and having a carpenter's pencil contouring surface defined about said rotational axis;

a blade mounted on said carpenter's pencil contouring portion and having a cutting edge positioned along said carpenter's pencil contouring surface for cutting against the carpenter's pencil as the carpenter's pencil is rotated; and a non-rotating carpenter's pencil centering portion fixed to said carpenter's pencil contouring portion and having a cylindrical inner surface for permitting the carpenter's pencil to rotate within said cylindrical inner surface and an outer end defining an entry to said cylindrical inner surface, said cylindrical inner surface having an inner diameter (ID) dimensioned to fit said maximum dimension (MD) of said carpenter's pencil and large enough to permit rotation of the carpenter's pencil within said cylindrical inner surface, for maintaining the carpenters pencil sufficiently parallel to said rotational axis to avoid jams and lead breaks at said blade, wherein radial motion of the carpenter's pencil relative to said rotational axis is limited while the carpenter's pencil is rotated within said cylindrical inner surface, said centering portion having a length parallel to said rotational axis and measured from said contouring surface to said outer end being at least approximately 1.25 inches.

17. The combination carpenter's pencil and carpenter's pencil sharpener of claim 16, wherein said cylindrical inner surface having an inner diameter (ID) of one selected from the group consisting of approximately 0.605 inches, 0.545 inches, 0.515 inches and 0.495 inches.

18. A combination carpenter's pencil and carpenter's pencil sharpener for cutting a point on a carpenter's pencil, comprising:

a carpenter's pencil having a longitudinal axis, a non-circular cross section orthogonal to the longitudinal axis, and a maximum dimension (MD of the non-circular cross section of at least 0.450 inches;

a carpenter's pencil contouring portion having a carpenter's pencil point contour surface defined therein and defined about a rotational axis;

a blade mounted on said carpenter's pencil contouring portion, said blade having a cutting edge positioned along said carpenter's pencil point contour surface for cutting against the carpenter's pencil when the carpenter's pencil is rotated about said rotational axis; and a non-rotating carpenter's pencil centering portion extending from and free of moving part relative to said carpenter's pencil contouring portion and having a length (L) for centering the carpenter's pencil along said rotational axis, said length (L) of said carpenter's pencil centering portion being at least 60% as long as said carpenter's pencil contouring portion measured parallel to said rotational axis.

19. A combination carpenter's pencil and carpenter's pencil sharpener for cutting a point on a carpenter's pencil, comprising;

a carpenter's pencil having a longitudinal axis, a non-circular cross section orthogonal to the longitudinal axis, and a maximum dimension (MD) of the non-circular cross section of at least 0.450 inches;

a carpenter's pencil contouring portion having a carpenter's pencil point contour surface defined therein and defined about a rotational axis;

a blade mounted on said carpenter's pencil contouring portion, said blade having a cutting edge positioned along said carpenter's pencil point contour surface for cutting against the carpenter's pencil when the carpenter's pencil is rotated about said rotational axis; and a non-rotating carpenter's pencil centering portion free of moving parts relative to said carpenter's pencil contouring portion and fixed to said carpenter's pencil contouring portion, said non-rotating carpenter's pencil centering portion having a length (L) selected for restricting radial movement of the carpenter's pencil relative to said rotational axis, said length (L) of said non-rotating carpenter's pencil centering portion being at least 60% of the length of said carpenter's pencil contouring portion, wherein said non-rotating carpenter's pencil centering portion maintains the carpenter's pencil along said rotational axis as the carpenter's pencil is rotated within the non-rotating carpenter's pencil centering portion.

20. A combination carpenter's pencil and carpenter's pencil sharpener for cutting a point on a carpenter's pencil, comprising:

a carpenter's pencil having a longitudinal axis, a non-circular cross section orthogonal to the longitudinal axis, and a maximum dimension (MD) of the non-circular cross section of at least 0.450 inches;

a carpenter's pencil contouring portion defining a rotational axis and a carpenter's pencil contouring surface defined about said rotational axis;

a blade mounted on said carpenter's pencil contouring portion and having a cutting edge positioned along said carpenter's pencil contouring surface for cutting against the carpenter's pencil as the carpenter's pencil is rotated; and a non-rotating carpenter's pencil centering portion fixed to said carpenter's pencil contouring portion and having a cylindrical inner surface for permitting the carpenter's pencil to rotate within said cylindrical inner surface and an outer end defining an entry to said cylindrical surface, said carpenter's pencil centering portion having a length parallel to said rotational axis and measured from said carpenter's pencil contouring surface to said outer end, and said cylindrical inner surface having an inner diameter of one selected from the group consisting of approximately 0605 inches, 0.545 inches, 0.515 inches and 0.495 inches.

21. The combination carpenter's pencil and carpenter's pencil sharpener of claim 20, wherein said length measured from said contouring surface to said outer end being at least approximately 1.25 inches.

* * * * *